US006561492B1

(12) United States Patent
Hubbell

(10) Patent No.: US 6,561,492 B1
(45) Date of Patent: May 13, 2003

(54) WOOD CLAD GUARDRAIL ASSEMBLY

(76) Inventor: David Allen Hubbell, 112 Park Ave., Saranac Lake, NY (US) 12983

( * ) Notice: Subject to any disclaimer, the term of this patent is extended or adjusted under 35 U.S.C. 154(b) by 0 days.

(21) Appl. No.: 09/676,472

(22) Filed: Oct. 2, 2000

(51) Int. Cl.[7] ..... A01K 3/00
(52) U.S. Cl. ..... 256/13.1; 256/19
(58) Field of Search ..... 256/13.1, 19; 52/184, 52/483.1, 730.7

(56) References Cited

U.S. PATENT DOCUMENTS 2,085,058 A * 6/1937 Wood
3,519,249 A 7/1970 Nave
4,007,917 A 2/1977 Brubaker
4,222,552 A 9/1980 Matteo, Sr.
4,662,611 A 5/1987 Ruane
4,722,513 A * 2/1988 Gaillard et al.
4,739,971 A * 4/1988 Ruane
4,946,138 A * 8/1990 Gaillard et al.
4,982,931 A * 1/1991 Pomero
5,169,127 A * 12/1992 Eynard
5,261,647 A 11/1993 Venegas, Jr. et al.
5,402,987 A * 4/1995 Duyck et al.
5,429,449 A 7/1995 Baatz
5,462,258 A * 10/1995 Gaillard et al.
5,507,473 A * 4/1996 Hammer et al.
5,713,161 A * 2/1998 Veldoen
5,960,721 A * 10/1999 Huetteman et al.
6,231,031 B1 * 5/2001 Michael et al. ..... 256/65.01
6,290,212 B1 * 9/2001 Bartel ..... 256/65.01

* cited by examiner

*Primary Examiner*—Lynne H. Browne
*Assistant Examiner*—John R. Cottingham
(74) *Attorney, Agent, or Firm*—Shlesinger, Arkwright & Garvey LLP

(57) ABSTRACT

A guardrail assembly for highways comprises a horizontal rail secured to a plurality of posts. The rail includes top, bottom and front walls. A first wood plank is secured to the top wall. A second wood plank is secured to the front wall. The second wood plank includes a front surface and a third wood plank is secured to the second wood plank front surface. The post are also wood clad.

31 Claims, 8 Drawing Sheets

WOOD CLAD GUARDRAIL ASSEMBLY

FIELD OF THE INVENTION

The present invention relates generally to a guardrail assembly for highways and particularly to a wood clad crash barrier wherein the cladding acts as lubricant between an impacting object and the barrier.

BACKGROUND OF THE INVENTION

The present invention addresses problem issues with the prior art guardrail and posts, such as reducing friction between an impacting vehicle and the prior art highway crash barriers, providing potential additional structural strength to individual structural members of the prior art crash barriers and support posts, allowing the use of a wood exterior appearance without the need to use potentially environmentally harmful wood preservative treatment, and providing an improved visibly pleasing external appearance for prior art guardrail and posts.

The primary function of guardrails and median barriers is to safely redirect errant vehicles. Guardrail installations on shoulders prevent vehicles from crashing onto steep embankments or fixed objects, and median barriers are used between roadways of divided highways to prevent across-the-median collisions with opposing traffic. Properly designed installations accomplish the redirection of errant vehicles in such a manner as to minimize the risk of injury to vehicle occupants as well as the involvement of other vehicles in the following and adjacent traffic. Other desirable guardrail and median barrier system characteristics include minimal damage to vehicles and barrier systems and economy in construction, installation and maintenance.

There are four basic highway guardrail and bridgerail barriers in common use. One is the W-shaped corrugated, heavy gauge sheet metal barrier, horizontally placed, and supported by posts usually anchored in the ground. Another consists of steel cable strands supported by posts usually anchored in the ground. There are also a number of reinforced concrete barriers of different cross-sectional shapes. Finally, there are a number of "tubular" barriers, usually consisting of steel, designed either as a single or multiple horizontal rails with support posts usually anchored in the ground and/or bridge deck. These and other barrier designs are required to meet various government mandated performance standards.

The present invention is directed to certain design and performance issues regarding crash barriers, namely, redirection of impacting vehicles; deceleration of vehicle and passengers; after-impact performance characteristics of the vehicle and cross-sectional shapes of individual components and subsystems addressing issues such as aerodynamic considerations and post-crash behavior of the passengers.

Redirection of impacting vehicles is a function of "attack-angle," speed, mass of impacting vehicle, center-of-gravity of the impacting mass three-dimensionally vis-a-vis the impacted barrier and the "deflection" or "pocket" size and shape the impact produces in the crash barrier. The maximum "attack-angle" dictated by U.S. and State Government performance standards is 25 degrees. This means, and addressing only the horizontal plane, the "transverse" vector to the barrier is 25 degrees and the "longitudinal" vector to the barrier is, therefore, 65 degrees. The initial friction developed by the impacting vehicle and the barrier, the transverse attack-angle increases, usually resulting in greater or deeper "pocketing" on the barrier by the impact vehicle.

In the case of "rigid" concrete barrier, increased initial friction usually results in the impacting vehicle developing an additional vertical-vector component, usually resulting in increased re-directional instability, i.e. roll-over.

Due to deeper pocketing and re-directional instability, the higher the friction between the impacting vehicle and the barrier, the higher the deceleration, which results in greater injury and damage being inflicted on the passengers, the vehicle and the barrier.

Post-impact performance-characteristics of vehicle and the passenger behavior are usually a question of the "exit-angle" or redirection of the vehicle after it leaves contact with the railing system. This is also known as the "bounce". What is usually undesirable is when the vehicle develops a significant exit angle, thereby causing the vehicle to re-enter the travel-path of the highway or, worst, cross over into on-coming traffic. The bounce performance characteristics are influenced by the depth of the deflection of the rail system, or pocketing, the energy absorbed by the rail system, the energy absorbed by the deformation of the impacting vehicle and the inherent rigidity of the rail system in question. That is, if the vehicle penetrates the rail, developing a pocket that is "stiff," there will be a tendency for the forward third of the pocket's rail to become perpendicular to the path of the vehicle. This results in either too rapid a halt of the forward progress of the impacting vehicle, and/or the development of a significant exit-angle, or over-stressing the rail system to rupture.

There are a number of support post configurations in common use. Those barriers which incorporate support posts usually use "wide-flange" or "I" beam structural shapes or cold-rolled shapes formed from sheet metal usually in the cross-section of a "U" or "C". Similar post materials are used singularly or in multiples to support mounting of items, such as signs near the travel-way of highways.

OBJECTS AND SUMMARY OF THE INVENTION

It is an object of the present invention to provide guardrails and structural support posts with reduced friction between an impacting vehicle and the barrier and post.

It is another object of the present invention to provide guardrails and structural support posts with potential additional structural strength to individual structural members of the prior art highway crash barriers and posts.

It is still another object of the invention to allow the use of a wood exterior appearance on guardrails or structural support posts without the need to use potentially environmentally harmful wood preservative treatment, since the wood cladding need not be structural and potential amounts of wood decay may improve the friction reducing feature of the cladding.

It is another object of the present invention to provide guardrails and structural support posts with an improved pleasing external appearance.

It is still another object of the present invention to provide support posts in a guardrail assembly that act as structural components of a composite structural member that would tend to add "stiffness" in addition to increased load transfer ability to the post in question.

It is another object of the present invention to provide support posts in a guardrail assembly that provide a greater distribution of impact energy over the impacted area of the post, energy absorption via fracturing of the cladding, lubrication via the fractured cladding parts between the metal post and the impacting vehicle, thereby allowing the vehicle to "get-past" the post and not snag as the vehicle "rides" the horizontal railing element.

It is still another object of the present invention to provide support posts in a guardrail assembly as a composite structural element in conjunction with the metal post with additional torque-resistance.

It is another object of the present invention to provide support posts in a guardrail assembly with resistance to the metal post elements' potential for "localized-buckling".

It is another objective of the present invention to provide specific aerodynamic characteristics to individual components such as rails and posts and individual subsystems such as rail/block/post systems, for purposes such as snow and/or sand issues.

It is another object of the present invention to provide a guardrail assembly which is applicable to both retro-fitting of existing barriers and posts and to new barrier and post applications.

In summary, the present invention provides a guardrail assembly for highways, comprising a horizontal rail secured to a plurality of posts. The rail includes top, bottom, front and back walls. A first wood plank is secured to the top wall. A second wood plank may be secured to the front and/or back wall. The second wood plank includes a front surface and a third wood plank is secured to the second wood plank front surface. Another plank can be attached to the back wall to provide a completely wood appearance. Plank attachments may be of glued laminated construction if for structural use, or intentionally laminated without glue to provide non-shear structural transfer characteristics between individual planks. Plank thickness can significantly vary as per design requirements. The post are also wood clad.

These and other objects of the present invention will become apparent from the following detailed description.

BRIEF DESCRIPTIONS OF THE DRAWINGS

DETAILED DESCRIPTION OF THE INVENTION

The present invention will be described using a standard U.S. Federal Highway Administration NCHRP 350 Test Level 3 steel box beam highway guiderail. However, a person skilled in the art will understand that the teachings of the present invention would be equally applicable to other types of guardrails.

Figures 1, 2:
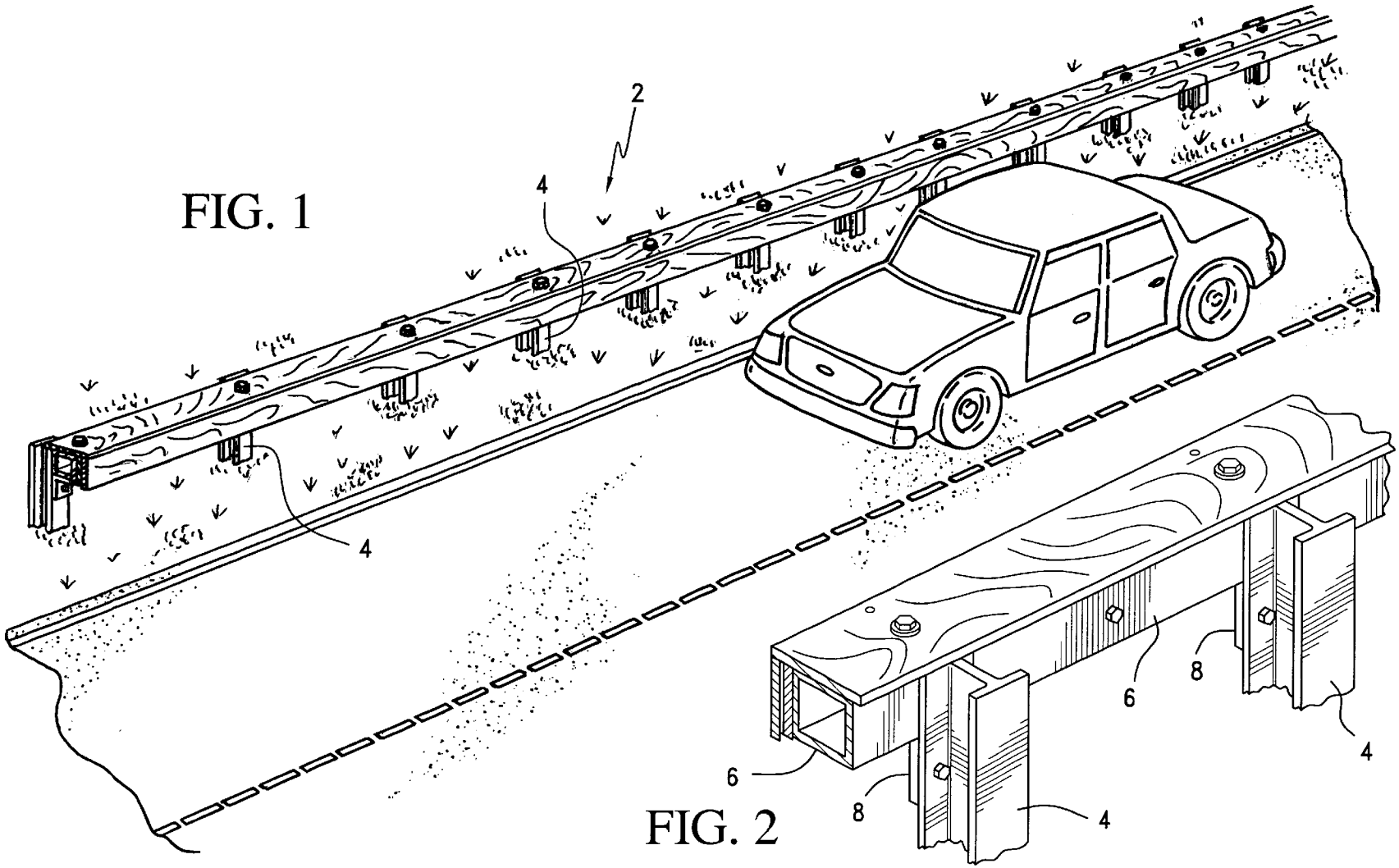
FIG. 1 is a perspective view of a guardrail made in accordance with the present invention.
FIG. 2 is an enlarged perspective view of the guardrail of FIG. 1.

A guardrail 2 made in accordance with the present invention is disclosed in FIGS. 1 and 2. The guardrail 2 is installed along a roadway to stop an errant vehicle in a controlled manner. The guardrail 2 includes a plurality of posts 4 for supporting a horizontal steel box beam 6. A plurality of angle brackets 8 secured to respective posts by means of bolts 10 (FIG. 3) provide support to the beam 6.

Figure 3:
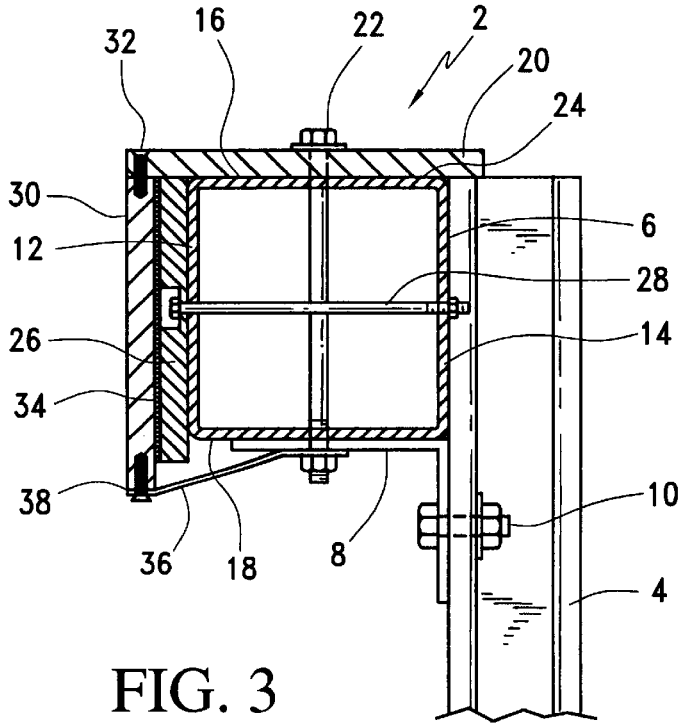
FIG. 3 is a cross-sectional view taken along line 3—3 of FIG. 4.
Figure 4:
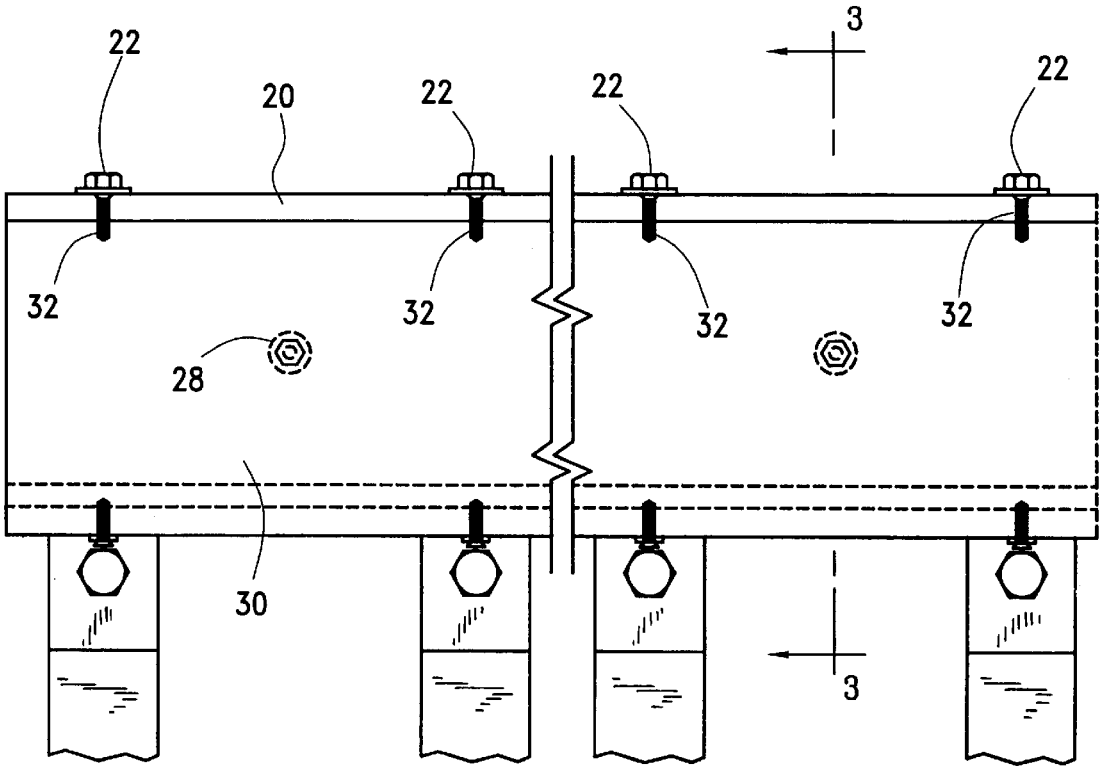
FIG. 4 is a front elevational view of FIG. 3.

Referring to FIG. 3, the steel box beam 6 has a front wall 12, a rear wall 14, a top wall 16 and a bottom wall 18. A wood plank 20 is secured to the top wall 16 with a bolt 22 or other standard means. A wax layer 24 or other low-friction materials may be disposed in the interface between the wood plank 20 and the top wall 16. A wood plank 26 is secured to the front wall 12 by means of a bolt 28 or other standard means. Another wood plank 30 disposed against the traffic side of the wood plank 26 is secured in place by means of screws 32 driven through the wood plank 20. A wax layer 34 or other low-friction materials may be disposed in the interface between the wood planks 26 and 30. A strap 36 may be used to secure the lower edge of the wood plank 30 to the bracket 8 to keep the wood plank 30 from warping toward the traffic side of the roadway. Screws 38 and the bolts 22 are used to secure the straps 36. The wood plank 20 is preferably hardwood while the wood plank 30 is preferably softwood. The wood plank 30 may also be secured to the wood plank 20 by means of a dovetail joint, glue or other standard means. The wood plank 30 may also be secured to the wood plank 26 by means of a dovetail joint, glue or other standard means. While the planks shown are rectangular in cross-section, it is understood that the planks can be of any cross-sectional nature to provide a rail and/or post exterior appearance such as but not limited to round, oval, elliptical, half-circular, part circular, parabolic, cycloidal, catenary-like, aerodynamical, multi-sided, etc.

Figure 5:
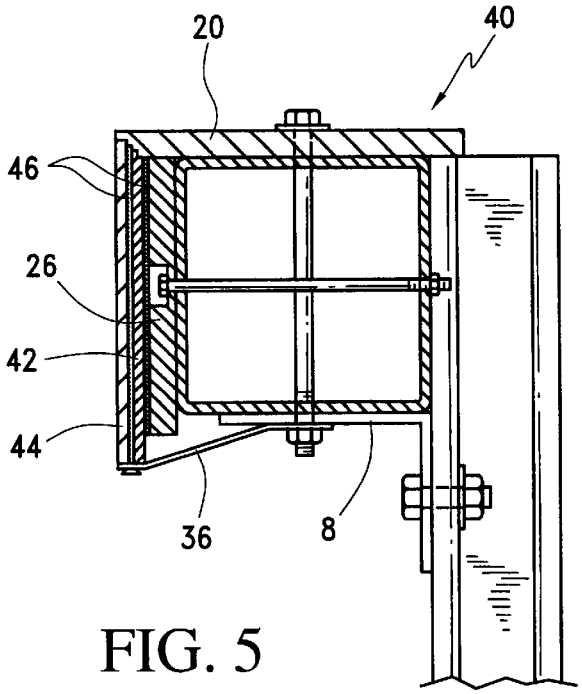
FIG. 5 is a cross-sectional view taken along line 5—5 of FIG. 6, showing another embodiment of a guardrail made in accordance with the present invention.
Figure 6:
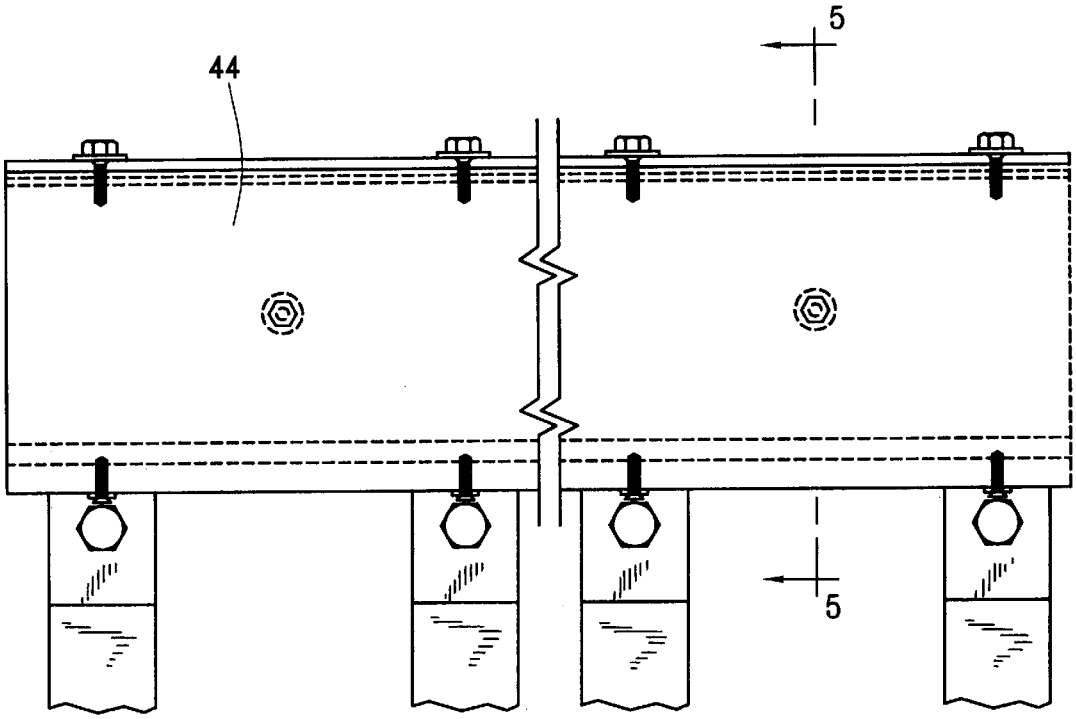
FIG. 6 is a front elevational view of FIG. 5.

Another embodiment of a guardrail 40 is disclosed in FIGS. 5 and 6. A plurality of wood planks 42 and 44 are secured to the wood plank 20 by glue or other standard means and to the bracket 8 by means of strap 36. The wood planks 42 and 44 may be either softwood and/or hardwood. Layers of wax 46 or other low-friction materials may be disposed in the respective interfaces of the wood planks 26, 22 and 44. Alternate spacing of structural glue and low-friction materials can also provide means of securing individual planks to each other.

Figure 7:
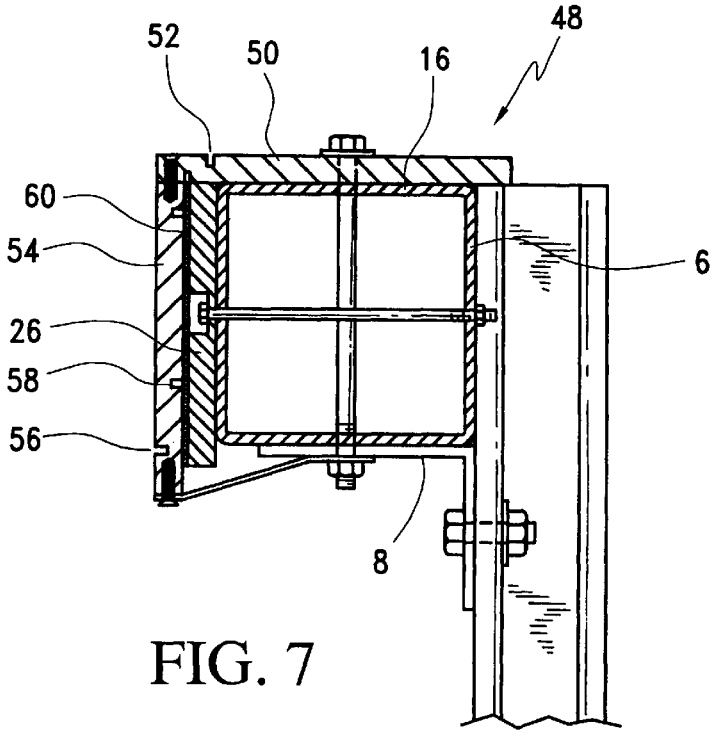
FIG. 7 is a cross-sectional view of taken along line 7—7 of FIG. 8, showing another embodiment of a guardrail made in accordance with the present invention.
Figure 8:
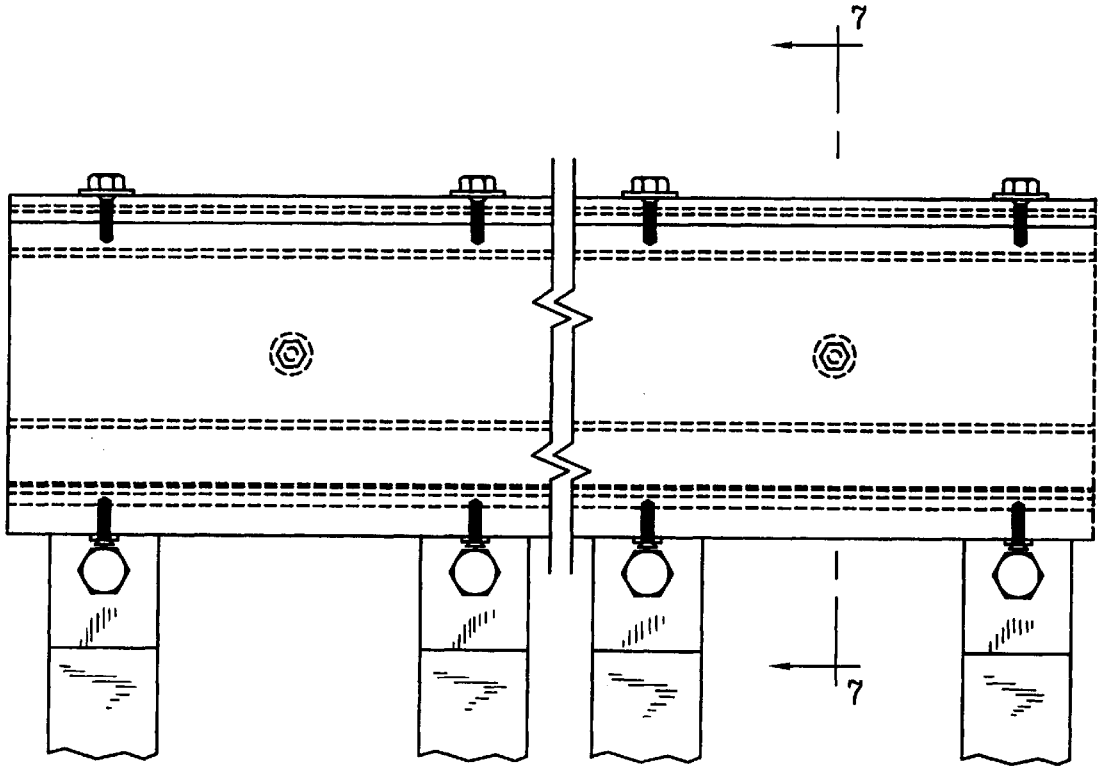
FIG. 8 is a front elevational view of FIG. 7.

Another embodiment of a guardrail 48 is disclosed in FIGS. 7 and 8. A wood plank 50 secured to the top wall 16 of the box beam 6 and is provided with a groove 52 running along the length of the plank. The groove 52 provides an area of structural weakness or pre-positioned shear planes. A wood plank 54 is secured to the wood plank 50 and the bracket 8 and is provided with exterior grooves 56 and interior grooves 58 running along the length of the plank. The grooves 56 and 58 provide areas of structural weakness and pre-positioned shear planes. A layer of wax 60 or other low-friction materials may be disposed in the interfaces between the planks 54 and 26.

Figure 9:
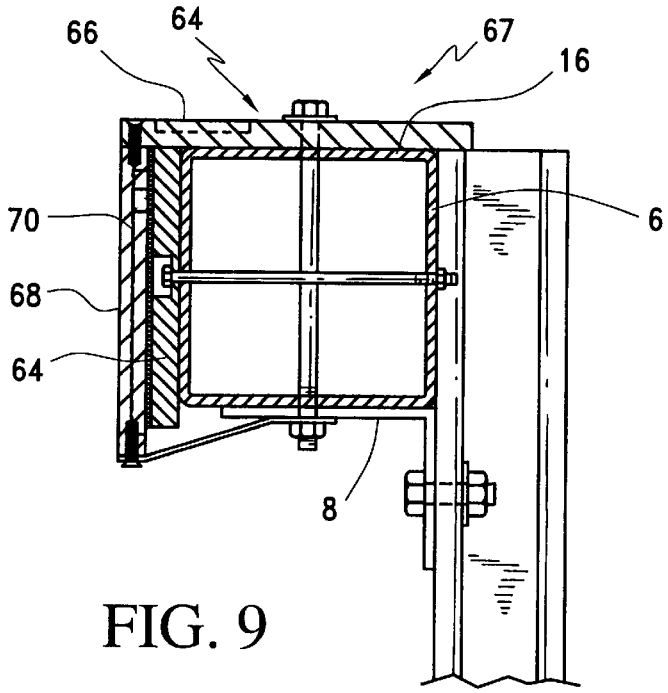
FIG. 9 is a cross-sectional view taken along line 9—9 of FIG. 10, showing another embodiment of a guardrail made in accordance with the present invention.
Figure 10:
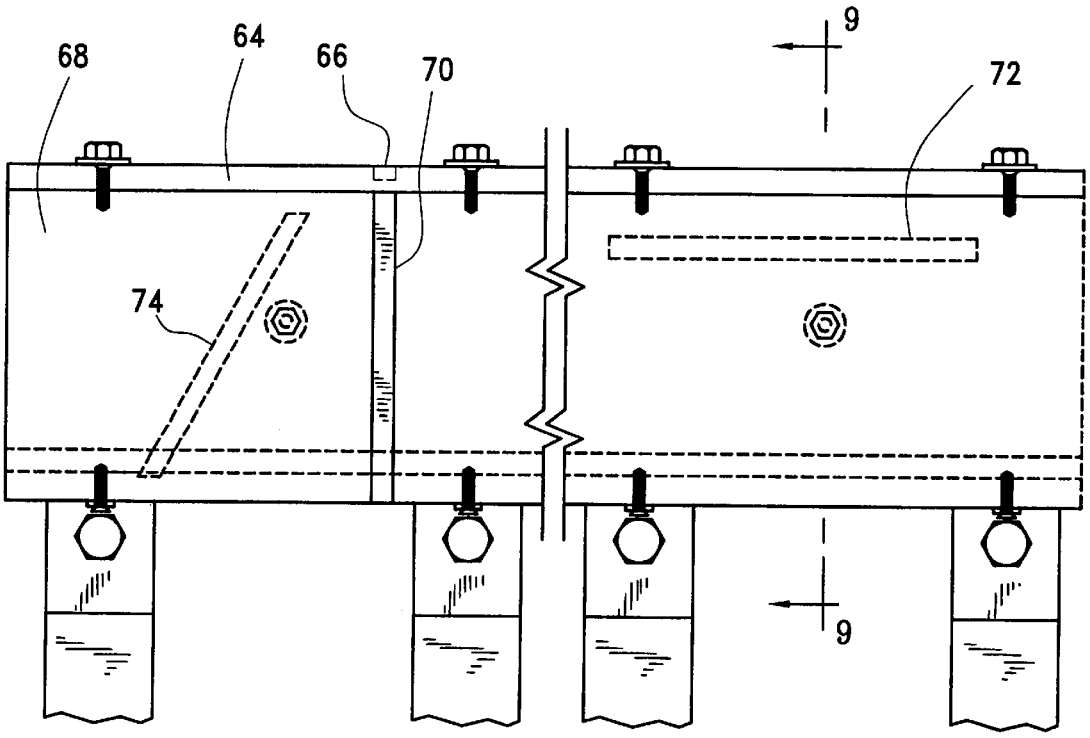
FIG. 10 is a front elevational view of FIG. 9.
Figure 11A:
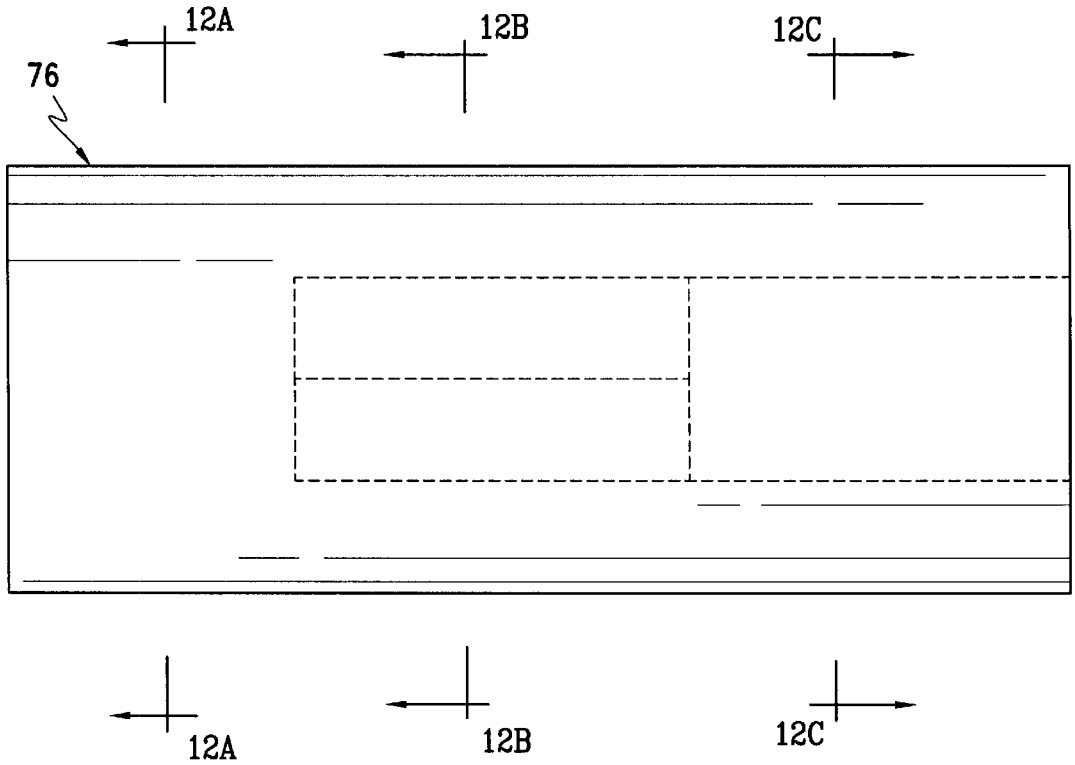
FIG. 11A is a longitudinal view of a wood cladding used to clad a metal post in accordance with the present invention.

Another embodiment of a guardrail 62 is disclosed in FIGS. 9 and 10. A wood plank 64 secured to the top wall 16 of the box beam 6 is provided with grooves 66 disposed across the width of the plank. The grooves 66 defines pre-positioned shear planes and areas of structural weaknesses. The groove 66 may either be disposed on the external surface of the wood plank or on an opposite surface adjacent the top wall 16. A wood plank 68 secured to the wood plank 64 and the bracket 8 is provided with a plurality of grooves 70 disposed vertically across the width of the plank. The grooves 70 define pre-positioned shear planes and areas of structural weakness. The grooves 70 may be disposed on the exterior or interior surface of the plank. The grooves 70 may also be disposed horizontally or diagonally, as generally shown at 72 and 74.

Figures 12A, 12B, 12C:
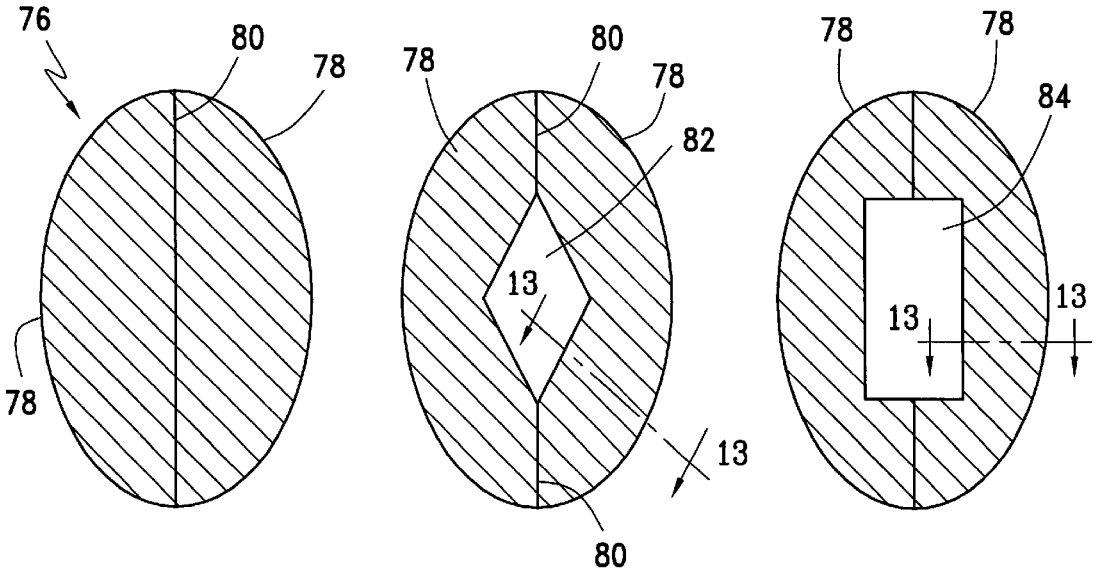
FIGS. 12A, 12B and 12C are cross-sectional views taken along lines 12A—12A, 12B—12B and 12C—12C in FIG. 11A.
Figure 11B:
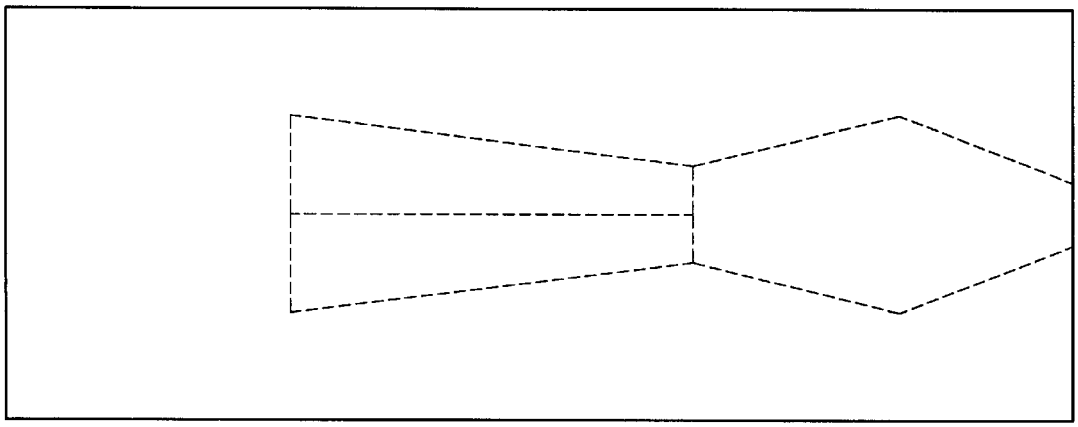
FIG. 11B is longitudinal view of a wood cladding similar to FIG. 11A, showing the hollowed void being non-uniform along the longitudinal axis.
Figure 14:
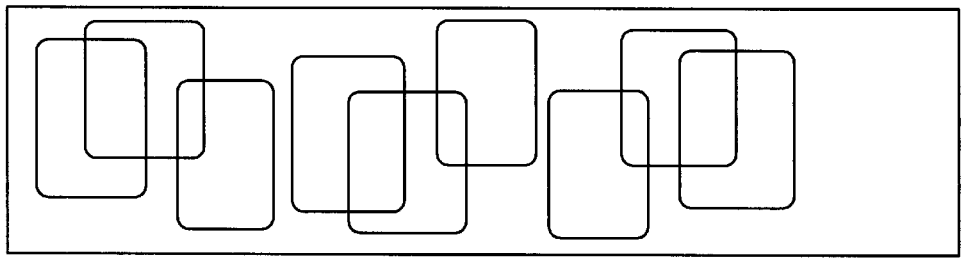
FIG. 14 is a side elevational view of the wood cladding shown in FIG. 11A.
Figure 13:
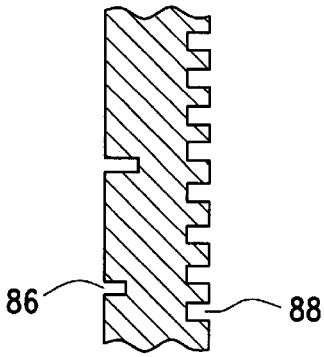
FIG. 13 is a schematic cross-sectional view taken along lines 13—13 FIGS. 12B or 12C.

The support posts 4 may be clad with wood to provide similar benefits as the wood clad box beam. Referring to FIGS. 11A and 12A–12C, a solid piece of wood 76 is cut longitudinally into sections 78 along line 80 to permit access to the interior volume, which is hollowed out into a void of a desired shape, such as a diamond-shaped void 82 and/or rectangular void 84, as best shown in FIGS. 12A, 12B and 12C. The void may be also circular or oval in cross-section. The shape of the void may vary longitudinally, as best shown in FIG. 11B, depending on the overall shape of the post being clad. The size, shape and location of the void is configured to receive the exterior dimension and the number of sides of the metal post being clad. For example, to clad a standard "H", "I", "W" or "C" post supporting a guardrail, the side of the post facing away from the traffic would not be clad, in which case, the void 84 may be moved off-center so it would have three sides and the back side of the post would be exposed. The several sections 78 are held together around the post with straps (not shown) or other standard means. The exterior and interior surfaces of the sections are provided with grooves 86 and 88, respectively, to define fracture planes or areas of weakness, as best shown in FIGS. 13 and 14. The exterior grooves 86 may be designed into an architectural treatment, as best shown in FIG. 14. The steel rail component may be clad with wood in a similar manner.

Figure 15:
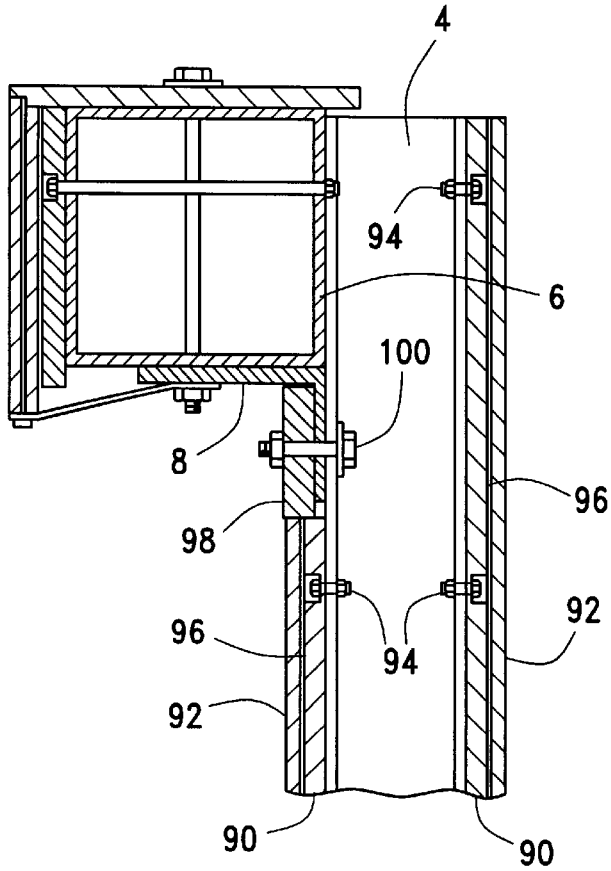
FIG. 15 is a cross-sectional view similar to FIG. 5, showing cladding for the bracket and support post.

Referring to FIG. 15, the post 4 is clad with inner and outer wood planks 90 and 92. Standard fastening means, such as nuts and bolts 94, are used to secure the inner wood planks 90 to the front and rear faces of the post 4. Screws or other standard means are used to secure the outer planks 92 to the inner planks 90. A layer of wax 96 or other similar material is sandwiched between the wood planks 90 and 92. A wood block 98 is used to cover the front face of the bracket 8 and is attached thereto with standard bolt and nut assembly 100 or other conventional means. The side faces of the post 4 may also be similarly clad with wood planks.

Figure 16:
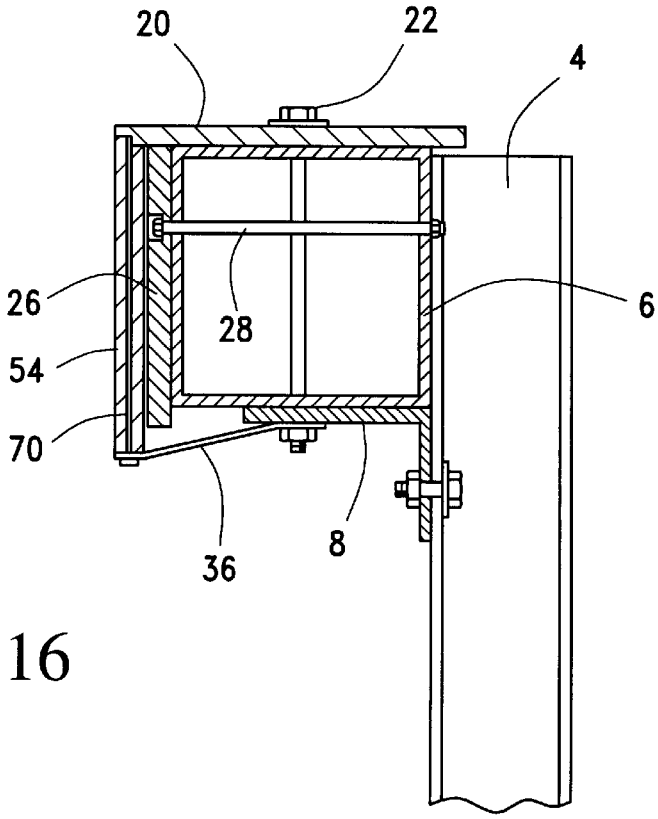
FIG. 16 is a cross-sectional view similar to FIG. 5, showing cladding for the roadside face of the rail extending downwardly to hide the support bracket from view.

Referring to FIG. 16, the wood planks 70 may extend downwardly to cover the front face of the support bracket 8 and thereby obscure it from the roadway and provide a larger cladding profile if desired.

The cladding is intentionally not structural at or near the "breakaway" component(s) of the post in question. That is, for the sign support posts using "slip-plate", "breakaway-bolts" or other similar devices, the cladding may or may not mask the breakaway device but the cladding itself does not contribute to either the operation and/or strength of the breakaway device. In the case of U-channel or other types of support posts which are inherently "breakaway" (do not use a specific breakaway device but rather the post material itself is designed to bend and break away when impacted), the cladding is intentionally not structural at the intended location (usually at or near the ground-line) for the post material failure point to assure the operation of the breakaway function. Frequently, there is a design concern that the post will flex or bend more than desired before activation of the breakaway function. That is, the post will bend before breaking away and thereby impose an unwanted vertical vector to the impacting vehicle in addition to causing potential for snagging the underside of the vehicle as it attempts to "pass-over" the bent post. This is addressed if the cladding is designed to be a "structural" component of the post design above or not at the physical point at the intended breakaway function. The direct result is that the post composite will deflect less on impact before activation of the breakaway function.

In addition to wood, the cladding may be made of plastic and/or other similar materials. The cladding is intentionally sacrificed upon impact of an errant vehicle or similar object. The cladding is intentionally manufactured with pre-positioned shear-planes and/or areas of weakness so as to fracture on impact and provide lubricant material to reduce friction from between the impacting vehicle and the barrier and the posts. The cladding with pre-positioned shear-planes break apart so as to not hinder the impacting vehicle's ride-down along a barrier. The cladding insulates an applied slick surface material such as, but not limited to, wax to either the inner surface of the cladding or the cladded over surface of the barrier. The cladding may be attached to the barrier in layers with or without an applied slick surface material to intermediate surface interfaces. The cladding may be of such construction and materials with inherent slick surfaces, such as but not limited to certain types of wood species and some plastics.

By affixing an initial layer of cladding to the box beam or post in the manner described above, shear developed due to an impacting vehicle or similar occurrence is transferred from the cladding to the underlying barrier or post from moment-in-time to moment-in-time through an errant vehicle's encounter with a barrier and/or post. Shear-transfer can be attained by a structural interface such as, but not limited to, glue, and/or screws and/or bolts and/or clamps and/or pre-designed interlocking physical structures involving the cladding and the barrier and/or posts. Additional cladding layers may be placed on the affixed composite cladding layer.

By using cladding as sacrificial material, which at first impact provides a small amount of energy-absorption via crushing, the present invention provides some dispersion of the impact energy over a larger area of the impacted rail, and the cladding sacrifices itself thereby reducing friction between the impacting vehicle and rail, continues to absorb impact energy by shearing, fracturing as the vehicle rides the rail. All of these actions reduces the deceleration rate for both vehicle and passengers by reducing the tendency of the vehicle to increase its impact angle due to initial friction with the rail and after-initial-impact friction as the vehicle rides the rail. An auxiliary effect is the reduced pocketing, thereby influencing the size of the exit-angle.

A pleasing external-appearance is obtained from prior art barriers and support posts by encasing some or all of the exposed metal and/or concrete surfaces of the barriers and/or support posts.

Application of an inner cladding, with or without applied slick surfaces, on the intended traffic-side of the barrier and/or support posts followed by an outer layer of cladding allows for a more economic construction while also protecting the slick surface materials from roadside environmental conditions which might degrade the slick materials slide-properties. An inner cladding layer also hides the inner steel and/or concrete surfaces in the location of the outer cladding layers' joints.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A rail assembly for a highway guardrail or bridge rail, comprising:

a) a horizontal rail to be secured to a plurality of posts, said rail having a rear wall for being secured to the posts above the ground;

b) said rail including top, bottom and front walls;

c) a first wood plank secured to said top wall;

d) a second wood plank secured to said front wall, said second wood plank including a front surface; and e) a third wood plank secured to said second wood plank front surface.

2. A rail assembly as in claim 1, and further comprising a layer of wax disposed between said second and third wood planks.

3. A rail assembly as in claim 1, and further comprising a layer of wax disposed between said first wood plank and said rail top surface.

4. A rail assembly as in claim 1, and further comprising a layer of wax disposed between said third wood plank and said rail top surface.

5. A rail assembly as in claim 1, wherein said third wood plank includes a plurality of grooves.

6. A rail assembly as in claim 5, wherein said grooves are disposed on said third wood plank front surface.

7. A rail assembly as in claim 5, wherein said grooves are disposed on a back surface of said third wood plank.

8. A rail assembly as in claim 5, wherein said grooves are vertical.

9. A rail assembly as in claim 5, wherein said grooves are horizontal.

10. A rail assembly as in claim 5, wherein said grooves are inclined.

11. A rail assembly as in claim 1, wherein said first wood plank is hardwood.

12. A rail assembly as in claim 1, wherein said third wood plank is softwood.

13. A rail assembly as in claim 1, wherein said third wood plank is hardwood.

14. A rail assembly as in claim 1, wherein said horizontal rail has a box cross-section.

15. A guardrail for roadways, comprising:

a) a plurality of posts;

b) a rail assembly including first and second wood planks operatively secured to said posts;

c) a layer of wax disposed between said first and second wood planks; and d) said second wood plank is disposed toward a traffic side and adapted to shear from said first wood plank upon being hit by an errant vehicle.

16. A guardrail as in claim 15, wherein said first wood plank is hardwood.

17. A guardrail as in claim 15, wherein said second wood plank is softwood.

18. A guardrail as in claim 15, wherein:

a) said rail assembly includes a box rail secured to said posts; and b) said first wood plank is secured to a traffic side of said box rail.

19. A guardrail as in claim 15, wherein said second wood plank includes a plurality of pre-positioned shear planes.

20. A guardrail as in claim 19, wherein said shear planes are defined by a plurality of grooves.

21. A guardrail as in claim 20, wherein said grooves are disposed on a traffic side of said second wood plank.

22. A guardrail as in claim 20, wherein said grooves are disposed on a back surface of said second wood plank.

23. A guardrail as in claim 15, wherein said second wood plank includes a plurality of areas of structural weakness.

24. A guardrail as in claim 23, wherein said areas of structural weakness are defined by a plurality of grooves.

25. A guardrail as in claim 15, wherein said posts are clad in wood.

26. A guardrail as in claim 25, wherein said wood is solid cut longitudinally into sections and said sections are hollowed out within to create a void.

27. A guardrail as in claim 26, wherein said void is rectangular in cross-section.

28. A guardrail as in claim 26, wherein said void is diamond-shaped in cross-section.

29. A guardrail as in claim 15, wherein said wood planks are rectangular in cross-section.

30. A rail assembly as in claim 1, wherein said first wood plank includes a groove running along the length thereof.

31. A rail assembly as in claim 1, wherein said first wood plank includes a plurality of grooves disposed across the width thereof.

* * * * *